US006209778B1

(12) United States Patent
Henrikson et al.

(10) Patent No.: US 6,209,778 B1
(45) **Date of Patent: *Apr. 3, 2001**

(54) SLASH JACKET WITH A RETRACTABLE ATTACHMENT MEMBER

(75) Inventors: Damon Gunier Henrikson, Waukegan; Marcia Elizabeth Lausen, Evanston; Anastasios Jerry Vasilatos, Wilmette, all of IL (US)

(73) Assignee: ACCO Brands, Inc., Lincolnshire, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/100,468

(22) Filed: Jun. 19, 1998

(51) Int. Cl.[7] ..... B65D 27/00
(52) U.S. Cl. ..... 229/67.1; 229/67.3; 402/79
(58) Field of Search ..... 229/67.1, 67.2, 229/67.3, 67.4, 69, 68.2, 402, 405; 383/9, 14, 21, 120; 402/79

(56) References Cited

U.S. PATENT DOCUMENTS

| | | | | |
|---|---|---|---|---|
| 325,676 | | 9/1885 | Jenkins . | |
| 594,620 | | 11/1897 | Harris . | |
| 621,732 | | 3/1899 | Wyman . | |
| 673,387 | | 5/1901 | Dean . | |
| 783,365 | | 2/1905 | Coleman . | |
| 930,837 | | 8/1909 | Bushnell, Jr. . | |
| 979,213 | | 12/1910 | Shedd . | |
| 1,175,691 | | 3/1916 | Blizard . | |
| 1,463,827 | | 8/1923 | McNeill et al. . | |
| 1,574,838 | * | 3/1926 | Moore | 402/79 X |
| 1,743,305 | | 1/1930 | Banks . | |
| 1,774,215 | | 8/1930 | Weinthrop . | |
| 1,794,560 | | 3/1931 | Styll . | |
| 2,394,335 | * | 2/1946 | Shapiro | 383/9 |
| 2,599,768 | | 6/1952 | Losch, Jr. . | |
| 2,756,515 | | 7/1956 | Hoffman . | |
| 3,111,256 | * | 11/1963 | Hiersteiner | 229/67.3 |
| 3,224,661 | | 12/1965 | Tilton, Jr. . | |
| 3,351,064 | * | 11/1967 | Cohn | 383/97 X |
| 3,528,602 | | 9/1970 | Ritchie . | |
| 3,620,440 | | 11/1971 | Humphrey . | |
| 3,847,195 | | 11/1974 | Tyrseck . | |
| 4,109,850 | | 8/1978 | Meenan et al. . | |
| 4,485,962 | | 12/1984 | Farley . | |
| 4,549,688 | | 10/1985 | Ozmon et al. . | |
| 4,954,003 | * | 9/1990 | Shea | 402/79 |
| 5,031,772 | | 7/1991 | Woodriff . | |
| 5,050,792 | | 9/1991 | Segall . | |
| 5,125,561 | * | 6/1992 | Idstein | 402/79 X |
| 5,161,731 | | 11/1992 | Rivlin et al. . | |

(List continued on next page.)

FOREIGN PATENT DOCUMENTS

| | | | | |
|---|---|---|---|---|
| 477151 | * | 9/1951 | (CA) . | |
| 412683 | * | 7/1934 | (GB) . | |
| 862396 | * | 1/1953 | (GB) . | |
| 852997 | * | 11/1960 | (GB) | 229/69 |
| 4-339767 | * | 11/1992 | (JP) | 383/9 |

OTHER PUBLICATIONS

U.S. Design Application No. 29/089,708, filed Jun. 19, 1998, entitled "SLASH JACKET", of D. Hendrikson et al.

*Primary Examiner*—Jes F. Pascua
(74) *Attorney, Agent, or Firm*—Pennie & Edmonds LLP

(57) ABSTRACT

A file that has a back panel and a front panel. A retractable member is associated with the front and back panels. The retractable member is retractable to between sides of the panels and is extendable beyond edges of the panels. The retractable member is preferably attachable to a binder, and expandable gussets connect the front and back panels.

25 Claims, 7 Drawing Sheets

U.S. PATENT DOCUMENTS 5,174,606 * 12/1992 Hure .
5,186,565 * 2/1993 Jack ..... 402/79
5,256,130 * 10/1993 Kachel et al. .
5,275,438 * 1/1994 Struhl .
5,322,450 * 6/1994 Willing ..... 383/10 X
5,558,454 * 9/1996 Owen .
5,579,908 * 12/1996 Johnson .
5,678,943 * 10/1997 Parsons ..... 402/79
5,695,233 * 12/1997 Feldman ..... 402/79 X
5,711,750 * 1/1998 Christensen et al. .
5,720,427 * 2/1998 Kachel et al. .

* cited by examiner

SLASH JACKET WITH A RETRACTABLE ATTACHMENT MEMBER

BACKGROUND OF THE INVENTION

Traditional slash jackets are made from a single sheet of paper folded to provide front and back panels which are attached to each other. The back panel is generally rectangular, and the top portion of the front panel is cut off diagonally. The bottom and usually both lateral sides of the front and back panels are adhered to each other, forming a compartment for paper storage between the panels with an opening at the top of the jacket and with closed sides and bottom. The cutout section of the front panel permits a portion of papers kept in the jacket to be viewed, while the rectangular back panel and the full length closed side of the slash jacket securely retain the contents in the jacket.

Some slash jackets are made without any perforations. Others slash jackets, however, include a perforated edge for receiving binder rings, enabling the jacket to be bound in a binder, such as taught in U.S. Pat. No. 3,528,602. Papers stored in a slash jacket of this type may shift towards the perforated edge, requiring that they be moved back away from that edge before the jacket is placed within a binder. Also, binders that have such an edge must be made significantly wider than the width of the papers they are meant to carry to provide the necessary space for the stored papers in addition to the space required for the perforations.

In addition, traditional slash jackets, as taught in the '602 patent, are shaped to contain a only thin stack of papers and are not readily expandable. File pockets, on the other hand, such as disclosed in U.S. Pat. No. 5,161,731, are constructed to carry a thick stack of papers. The folder disclosed in the '731 patent has front and rear panels connected to each other along the bottom and lateral sides of the folder by gussets. The gussets along the sides of the folder are equally long, and the front panel extends straight across the top of the folder. These gussets allow the folder to expand, to fit a variable paper stack thickness.

U.S. Pat. No. 4,109,850 teaches a folder with an expandable pocket formed from a sheet. A front and a back of the pocket are connected by accordion type expansion zones located only on the bottom and one side of the pocket. The front is made from two overlapping portions that are not fixed to each other, but are connected by a slidable tab. This sliding tab arrangement, however, is relatively weak, and relies on a hinged leaf to cover the pocket.

SUMMARY OF THE INVENTION

The invention relates to file with a retractable member that can be extended beyond a lateral edge of the file, and that can also be retracted between front and back panels of the file. The retractable member includes a attachment member, such as a perforated portion configured to receive rings of a three-ring binder. When the retractable member is extended, the file is mountable in the binder. When the file is taken out of the binder, the retracted retractable member is protected from wear, and reduces the width of the file to enable storage in other files that are not significantly wider.

The preferred embodiment of the file is a slash jacket with a narrow open top and a diagonally cut front panel. The front panel is secured to the back panel on three sides, including on a narrow bottom and two opposite wide sides. The attachment member is connected to one of the wide sides to prevent papers from falling out of the jacket laterally when the jacket is placed within a binder. Also, the front and back panels are connected by an expandable portion, such as a gusset, permitting stacks of varying thicknesses to be contained within the jacket. dr

DETAILED DESCRIPTION OF THE PREFERRED EMBODIMENTS

Figure 1:
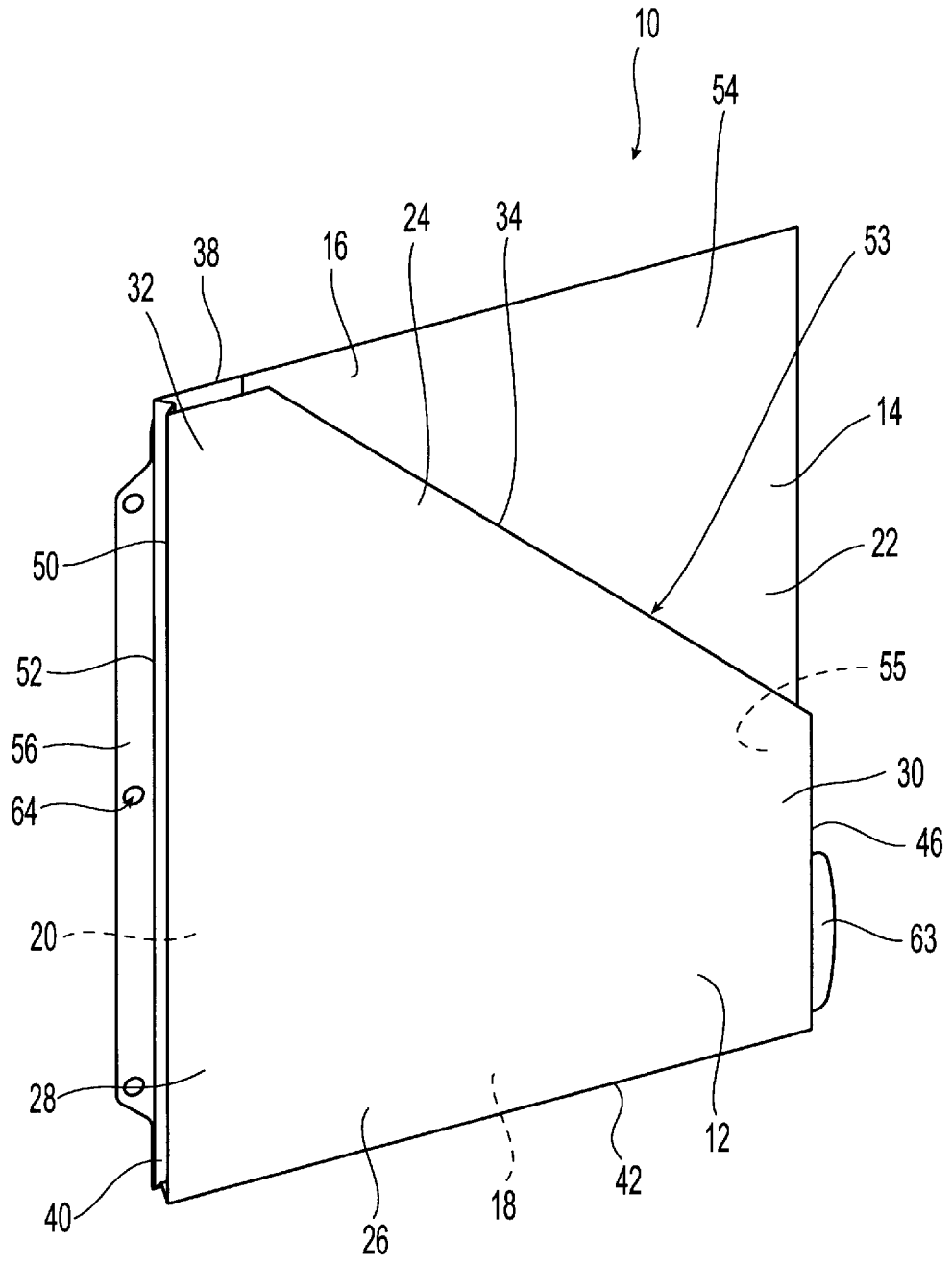
FIG. 1 is a top-left perspective view of a preferred embodiment of a slash jacket constructed according to the invention.
Figure 3:
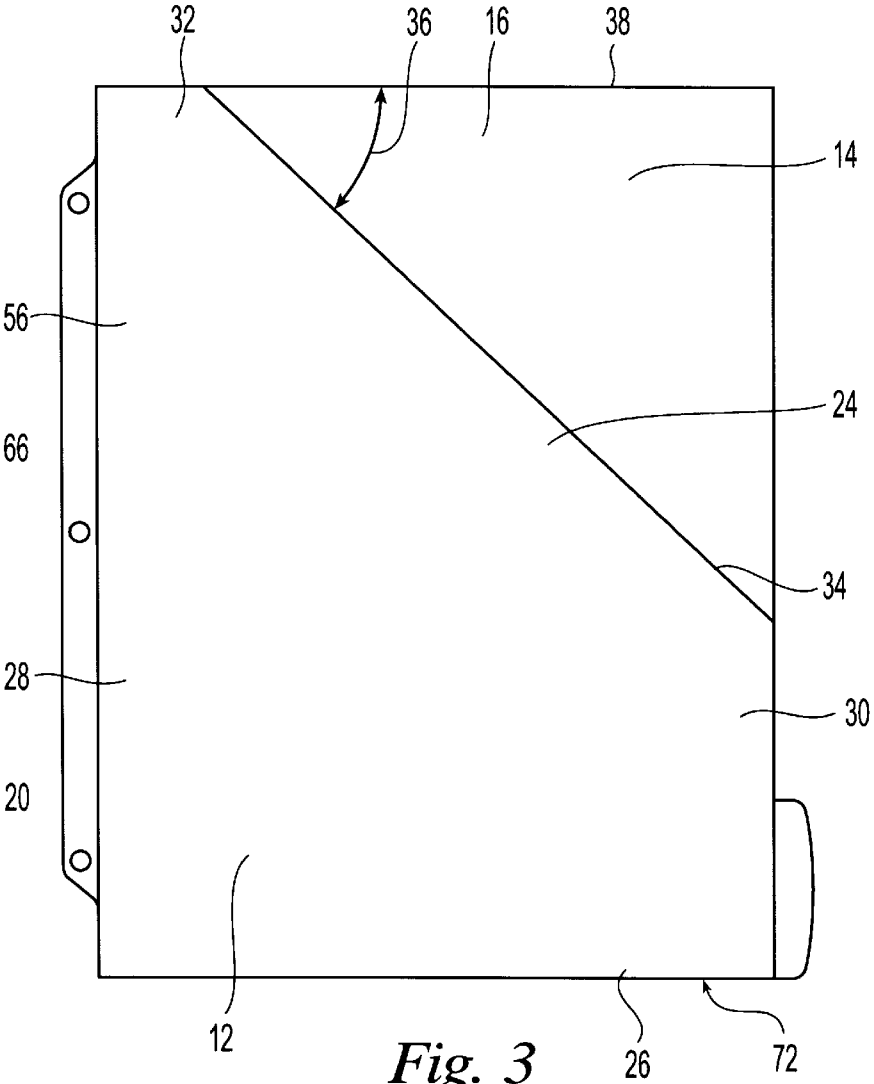
FIG. 3 is a front view of the jacket.
Figure 2:
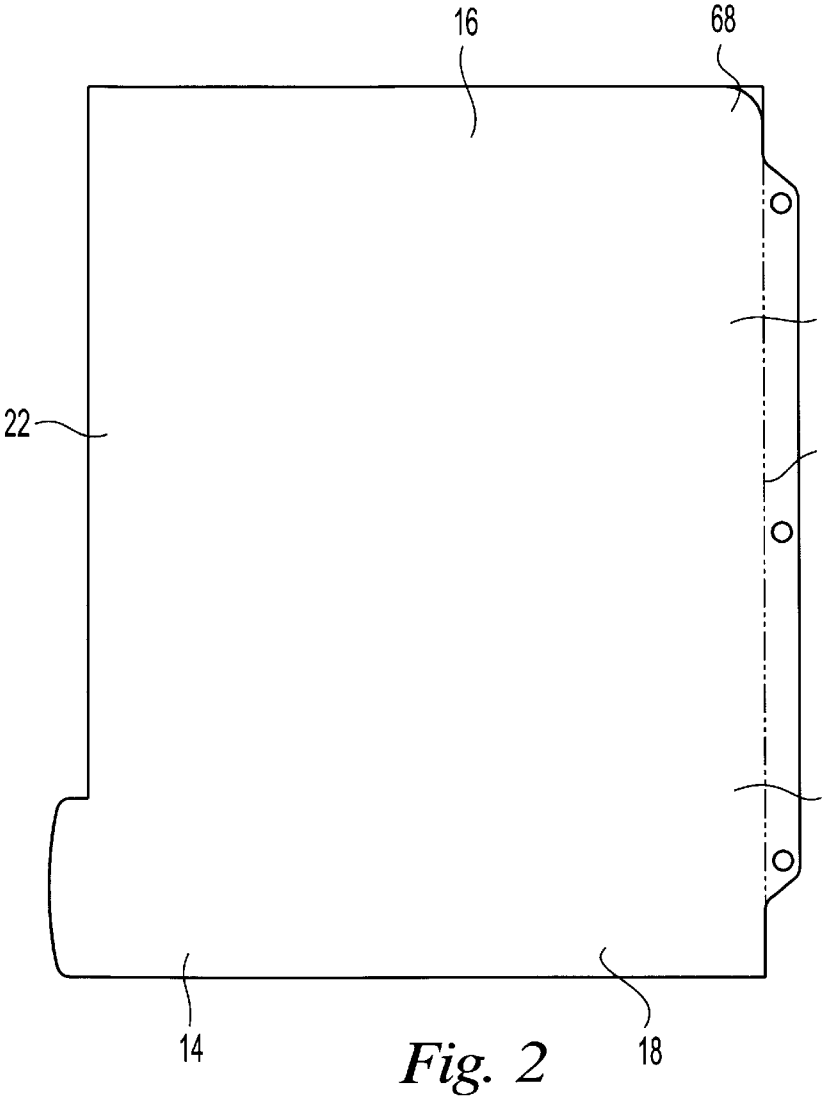
FIG. 2 is a back view of the jacket.

Referring to FIGS. 1–3, slash jacket file 10 is made from a single sheet of a paper material. The jacket 10 includes a front panel 12 and a back panel 14 which face each other.

The back panel 14 is rectangular, with back top and bottom sides 16 and 18 that are narrower than back left and right sides 20 and 22. The back top, bottom, left and right sides of the embodiment shown thus include back first, second, third, and fourth sides. The front panel 12 also has front diagonal, bottom, left, right, and top sides 24, 26, 28, 30, and 32, which in the embodiment shown include front first, second, third, and fourth sides. The front diagonal edge 34 of the front diagonal side 24 has a portion disposed at an angle 36 to back top edge 38 of the back top side 16. The angle 36 is preferably between 25° and 65°, and most preferably about 45°. The front top side 32 is relatively short compared to the back top edge 38 and is parallel thereto. The front right side 30 is shorter than the back right side 22 and is preferably less than half as long. The back left side 20 and the front left side 28 are preferably substantially coextensive and adjacent each other. The back bottom side 18 and the front bottom side 26 are also preferably substantially coextensive and adjacent each other. In the embodiment shown, the front and back panels 12 and 14 together define an outer file border 72.

Figure 4:
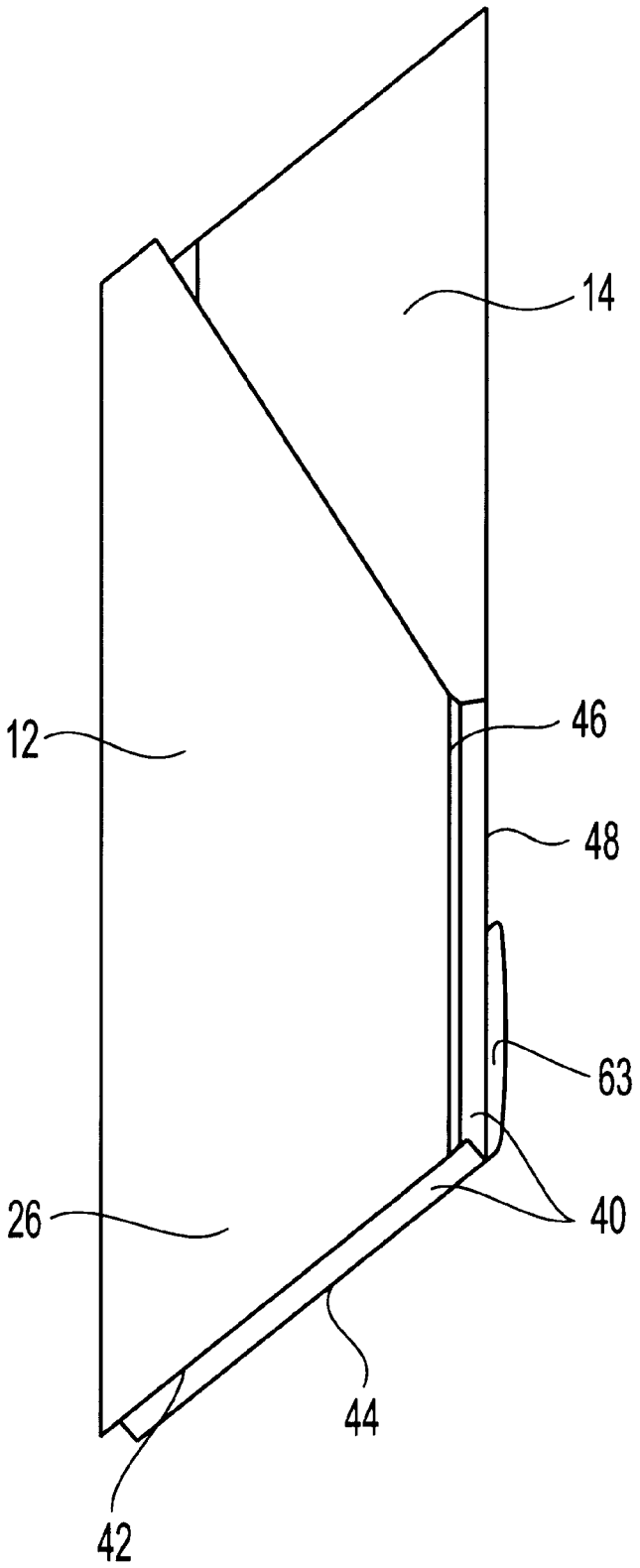
FIG. 4 is a bottom right perspective view of the jacket.

Referring to FIGS. 1 and 4, an expandable member 40 connects front left side 28 with the back left side 20, front bottom edge 42 of the front bottom side 26 with back bottom edge 44 of the back bottom side 18, and front right edge 46 of the front right side 30 with back right edge 48 of the back right side 22. The front diagonal side 24 and the back top side 16 are substantially free from each other, and in the preferred embodiment are only connected at the top of the left edges 50 and 52 through the expandable member 40.

A container compartment 53 is defined between the front and back panels 12 and 14 and the expandable member 40. The compartment 53 is open at the top, and is configured to receive a stack of papers so that a corner of the stack protrudes above the front diagonal side 24. The front and back panels 12 and 14 have insides and outsides 54 and 55, relative to the compartment 53. The expandable member 40 retains the contents of the compartment 53 on three sides thereof, ensuring that the contents will not slide out from the left or right sides of the jacket 10. The expandable member 40 includes a gusset that permits the front and back panels 12 and 14 to permit the front and back to separate and move towards each other while remaining substantially in parallel with each other, without widening or heightening the dimensions of the jacket.

Figure 6:
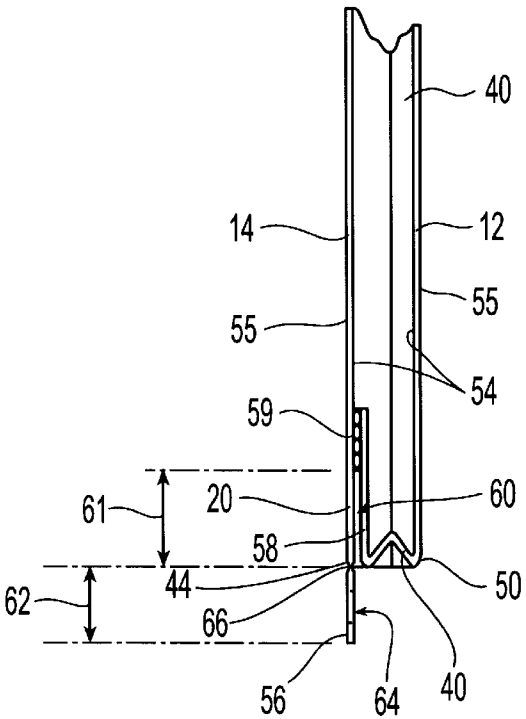
FIG. 6 is a top view of the left side of the jacket with a retractable member in an extended position.
Figure 5:
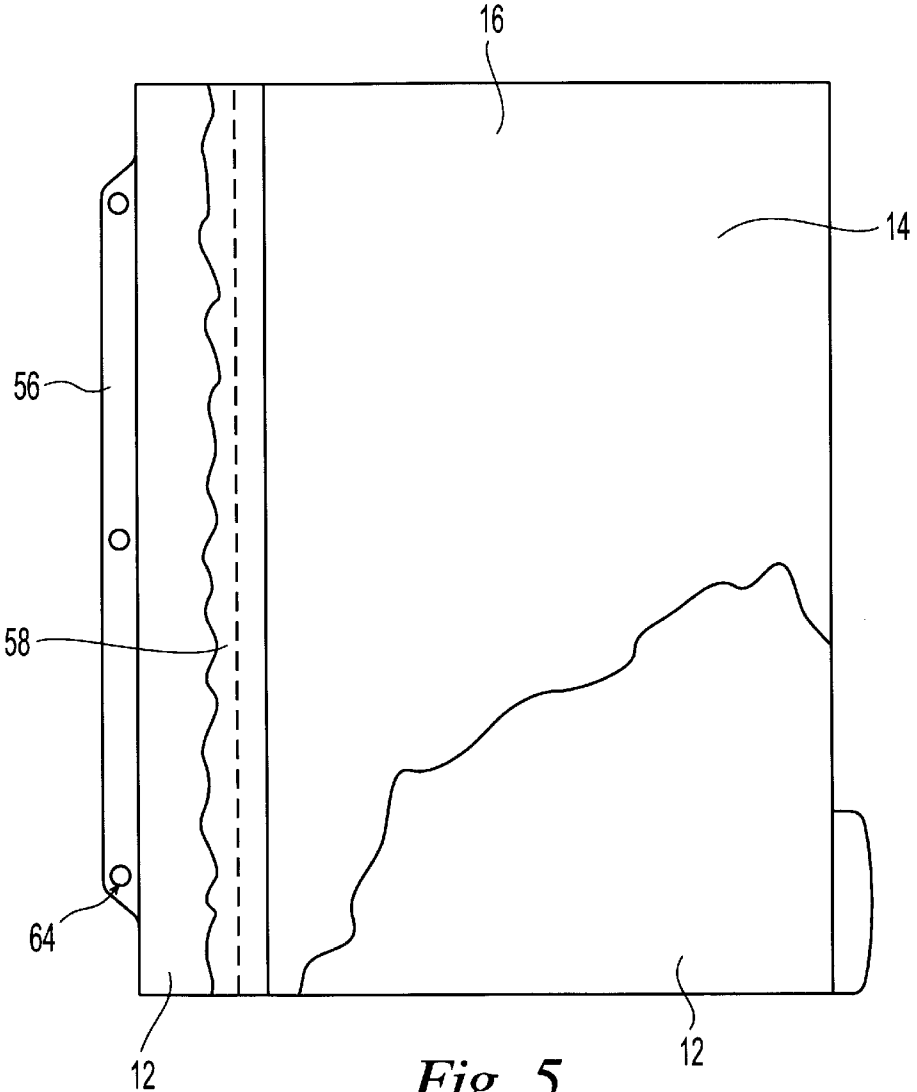
FIG. 5 is a cutaway front-view of the jacket.

The left side of the expandable member 40 is connected to front left edge 42 of the front left side 28, but back left edge 44 of the back left side 28 is substantially free from the expandable member 40 except at the bottom corner thereof. Referring to FIGS. 5 and 6, the expandable member 40 has an extension 58 adhered to the back panel 14 towards the right of the back left edge 44 with adhesive 59. A space 60 thus remains between extension 58 and the back left side 20. The retraction depth 61 of the space 60 is greater than the length 62 of the retractable member 56, and preferably is about a third longer.

A tab 63 is connected to the back panel 14, and extends laterally beyond the back right edge 48 for quick identification of the jacket 10. The expandable member 40 is adhered to the inside 54 of the back panel 12, to permit the tab 63 to be placed adjacent the expandable member 40. Preferably, a set of jackets includes jackets with tabs disposed in different positions along the back right edge, so that each tab may be seen when the jackets are bound in a binder.

The jacket 10 has a retractable member 56 associated with the front and back panels 12 and 14. Preferably, the retractable member 56 is a continuation of the back panel 14. The preferred retractable member 56 is an attachment member with perforations 64 configured to receive binder rings, for attaching the jacket in a standard ringbinder.

Figure 7:
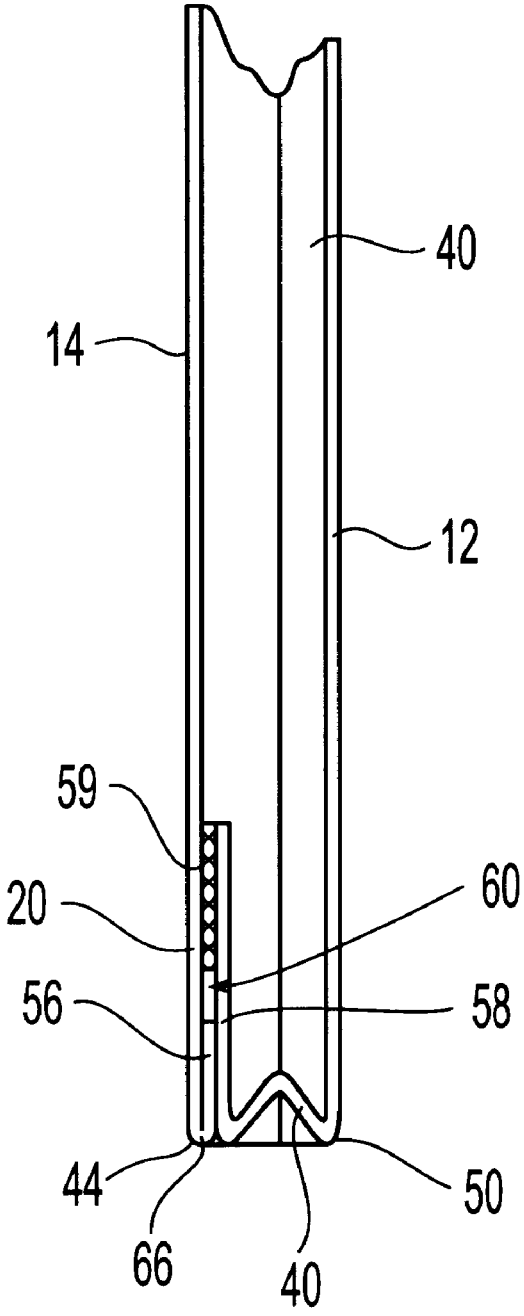
FIG. 7 is a top view of the left side of the jacket with the retractable member in a retracted position.

In FIGS. 1–6, the retractable member 56 is shown in an extended position, beyond the front and back left edges 42 and 44 for attachment to a binder. The retractable member 56 is also foldable to a retracted position in which the member 56 received in space 60 between the front and back left edges 42 and 44 and front and back left sides 20 and 28, as shown in FIG. 7. Member 56 is substantially flat, and substantially completely within the outer border 72 in the embodiment shown. A score 66 extends between the back panel 14 and the retractable member 56 along the back left edge 44, creating a weakened portion that provides a natural fold about which the retractable member 56 pivots between the extended and retracted positions.

Figure 8:
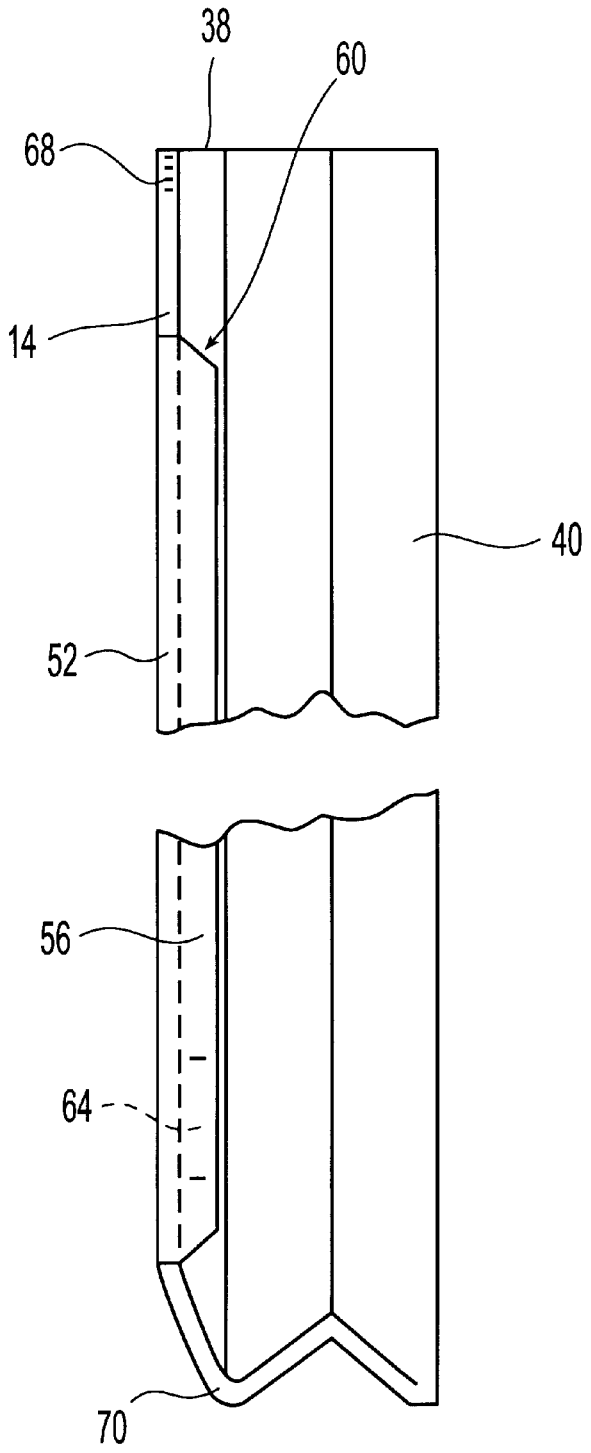
FIG. 8 is a side view of the jacket with the retractable member in the retracted position.
Figure 9:
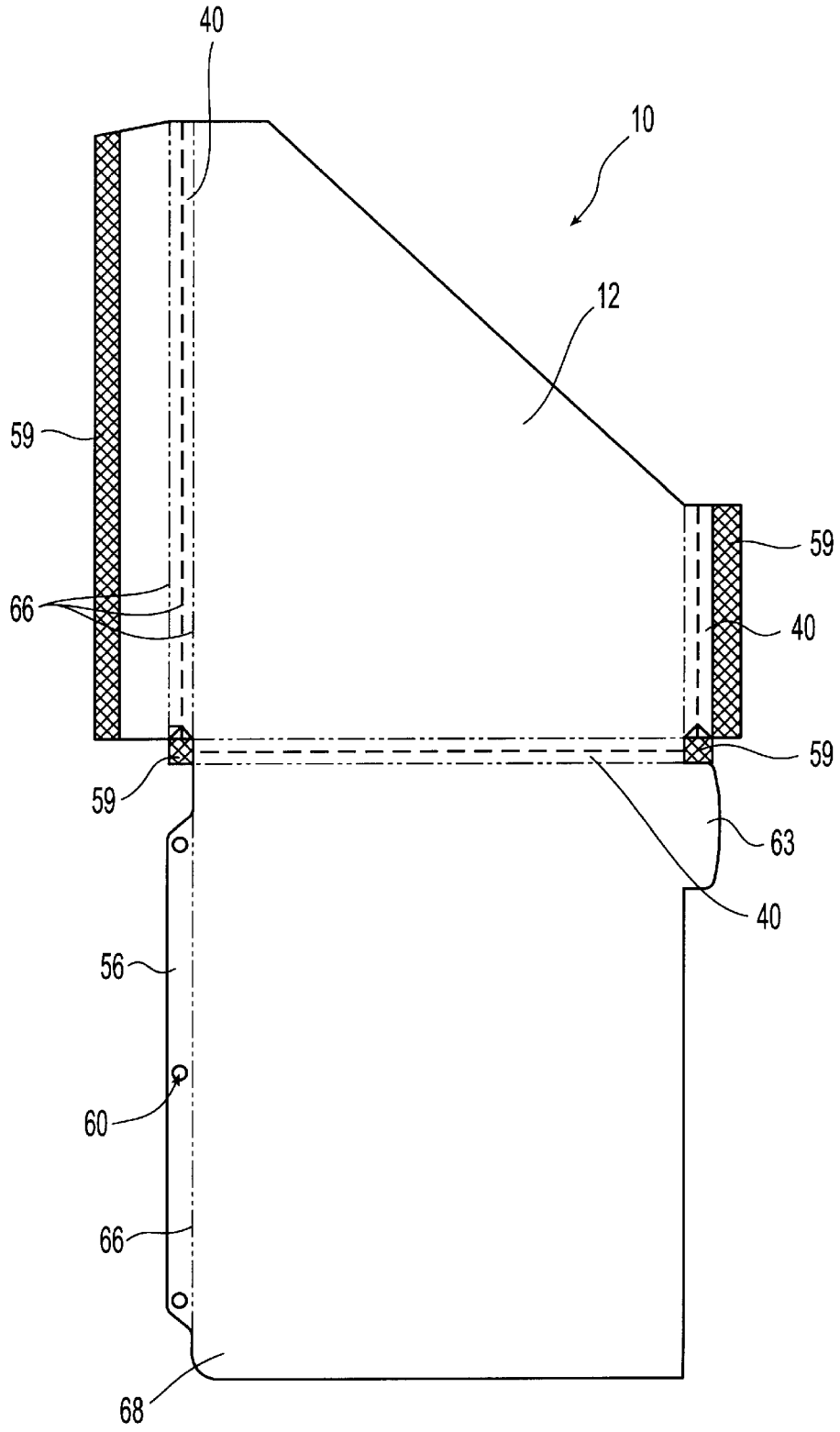
FIG. 9 is a view of the outside of a blank from which the jacket is manufactured.

As shown in FIG. 8, the back left edge 44 is substantially free and unattached from the extendable member 40 and thus from the front panel 12, including upper corner 68 of the back left edge 44, connecting this edge 44 with the back top edge 38. As shown in FIG. 2, corner 68 has a rounded contour to prevent snagging and to reduce wear. The bottom corner 70 of the back left edge 44, on the other hand, is fixed to the bottom of the expandable member 40, and thus to the front panel 12. The sheet of paper from which the jacket is made is preferably continuous across the front bottom side 26, the expandable member 40, and the back bottom edge 18 and the bottom of the back left edge 44. This construction keeps the portion of the back panel 14 that extends beyond where the back panel 14 is adhered to the Referring to FIG. 9, the entire jacket 10 is preferably made from a single, unitary paper blank. The front back panels 12 and 14 are each of integral construction. Scores 66 are made in the blank to produce the desired folds in the gussets of the expandable member 40 and between the back panel 14 and the retractable member 56. The blank is preferably made from a strong and durable paper material, such as manila or kraft paper.

One of ordinary skill in the art can envision numerous variations and modifications. For example, in an alternative embodiment, the retractable member is a retractable tab to which labels can be affixed. All of these modifications are contemplated by the true spirit and scope of the following claims.

What is claimed is:

1. A file for containing a paper stack, the file comprising:

(a) a back panel having a back first side with a back first edge;

(b) a front panel having a front first side with a front first edge disposed substantially adjacent the back first edge, wherein:

(i) the front and back panels are attached to each other along the front and back first sides, and (ii) the front and back first edges are substantially free from each other;

(c) a retractable member connected with the front and back panels such that the retractable member is retractable to a retracted position substantially completely received between the front and back first edges and front and back first sides, and is extendable beyond the first edges to an extended position, wherein the retractable member is foldable from the extended to the retracted position and comprises an attachment member to receive a plurality of binder rings of a single binder.

2. The file of claim 1, wherein the attachment member is attachable to the binder rings when in the extended position.

3. The file of claim 1, wherein the attachment member defines a plurality of perforations having a shape, dimension and position for receiving the plurality of binder rings.

4. The file of claim 1, wherein the attachment member is connected to the back panel.

5. The file of claim 4, further comprising a weakened portion extending between the back panel and the attachment member, the attachment member being foldable about the weakened portion.

6. The file of claim 5, wherein the weakened portion comprises a score.

7. The file of claim 1, wherein the back panel comprises a paper material.

8. The file of claim 1, wherein:

(a) the front panel has front second, third, and fourth sides;

(b) the back panel has back second, third, and fourth sides;

(c) the front and back third sides are connected to each other, the front and back fourth sides are connected to each other, and the front and back second sides are substantially free from each other; and (d) a container compartment is defined between the front and back panels.

9. The file of claim 1, wherein in the retracted position the retractable member is disposed substantially flat between the front and back first sides.

10. The file of claim 1, wherein a retraction space having a retraction depth is defined between the front and back first edges and the front and back first sides, and the retractable member is received within the retraction space in the retracted position, the retractable member extending from the first edges by a length which substantially is less than the retraction depth.

11. The file of claim 1, wherein the retractable member has a retractable width generally parallel to the first sides, and the back and front first edges have a width that is substanlly greater than the retractable width.

12. The file of claim 1, wherein the front and back panels define a container compartment therebetween and have front and back second sides, respectively, the second sides defining an open side of the file that is open to the compartment.

13. A slash jacket, comprising:

(a) a substantially rectangular back having back first and second sides and back top and bottom sides, the back top side having a back top edge;

(b) a front having front first and second sides and front diagonal and bottom sides, the front second side being shorter than the back second side, and the front diagonal side having a front diagonal edge disposed at an angle to the back top edge;

(c) an expandable member connecting:

(i) the front bottom side with the back bottom side, (ii) the front first side with the back first side, (iii) the front second side to the back second side, such that front and back are separable substantially in parallel with each other, wherein the front diagonal side and the back top side are substantially free from each other; and (d) an attachment member connected with at least one of the first second, and bottom sides and attachable to a binder.

14. The slash jacket of claim 13, wherein the front is of integral construction.

15. The slash jacket of claim 14, wherein the expandable member comprises a gusset.

16. The slash jacket of claim 15, wherein the gusset, front, and back are made from a single sheet of material.

17. The slash jacket of claim 13, wherein attachment member comprises a retractable member connected with the front and back panels such that the retractable member is retractable to a retracted position substantially completely received between the front and back first edges and front and back first sides, and is extendable beyond the first edges to an extended position.

18. The slash jacket of claim 13, wherein the back top and bottom sides are narrower than the back first and second sides, and the attachment member is connected with at least one of the first and second sides.

19. The slash jacket of claim 13, wherein the attachment member is connected with at least one of the first sides.

20. The slash jacket of claim 13, wherein the diagonal edge is a free edge.

21. A file for containing a paper stack, the file, comprising:

(a) a back panel having a back first side with a back first edge;

(b) a front panel having a front first side with a front first edge disposed substantially adjacent the back first edge, wherein;

(i) the front and back panels are attached to each other along the front and back first sides, and (ii) the front and back first edges are substantially free from each other;

(c) a retractable member connected with the front and back panels such that the retractable member is retractable to a retracted position substantially completely received between the front and back first edges and front and back first sides, and is extendable beyond the first edges to an extended position, wherein the retractable member is foldable from the extended to the retracted position and comprises an attachment member to receive binder rings of a binder;

wherein the first side of one of the front and back panels has a free corner that is free from the other of the front and back panels.

22. The file of claim 21, wherein the free corner has a rounded contour.

23. The file of claim 21, wherein the first side of said one of the panels has an attached corner disposed on an end on said first side of said one of the panels opposite from the free corner and connected to the other of the panels.

24. A file for containing a paper stack, the file comprising:

(a) a back panel having a back first, second, third, and fourth sides, the back first side comprising a back first edge, and the back second side comprising a back second edge;

(b) a front panel having front first, second, third and fourth sides, the front first side comprising a front first edge disposed substantially adjacent the back first edge, and the front second side comprising a front second edge disposed at an angle to the back second edge, wherein:

(i) the front and back first sides are connected to each other, (ii) the front and back first edges are substantially free from each other, (iii) the front and back second sides are substantially free from each other, (iv) the front and back third sides are connected to each other, (v) the front and back fourth sides are connected to each other, and (vi) a container compartment is defined between the front and back panels; and (c) a retractable member connected with the front and back panels such that the retractable member is retractable to a retracted position substantially completely received between the front and back first edges and front and back first sides, and is extendable beyond the first edges to an extended position, wherein the retractable member comprises an attachment member to receive binder rings.

25. A file for containing a paper stack, the file comprising:

(a) a back panel having a back first side with back first edge and having a back second side;

(b) a front panel having front first side with front first edge disposed substantially adjacent the back first edge and having a front second side disposed adjacent the back second side, wherein:

(i) the front and back first sides are attached to each other, (ii) the front and back second sides are attached to each other, (iii) the front and back first edges are substantially freely movable with respect to each other, and (iv) the front and back panels define an outer file border; and (c) a retractable member connected with the front and back panels such that the retractable member has a retracted position received between the front and back first sides and substantially completely within the outer border, and has an extended position in which the retractable member extends beyond the first edges, wherein the retractable member is foldable from the extended to the retracted position and comprises an attachment member including a plurality of openings configured and spaced for receiving and attaching to a plurality of rings of a single binder.

* * * * *